US011146003B2

(12) United States Patent
Benner et al.

(10) Patent No.: US 11,146,003 B2
(45) **Date of Patent: *Oct. 12, 2021**

(54) PLUGGABLE LGA SOCKET FOR HIGH DENSITY INTERCONNECTS

(71) Applicant: International Business Machines Corporation, Armonk, NY (US)

(72) Inventors: Alan F. Benner, Poughkeepsie, NY (US); Benjamin Vito Fasano, New Windsor, NY (US); Paul Francis Fortier, Richelieu (CA); Hilton T. Toy, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 201 days.

This patent is subject to a terminal disclaimer.

(21) Appl. No.: 16/108,350

(22) Filed: Aug. 22, 2018

(65) Prior Publication Data

US 2018/0358725 A1 Dec. 13, 2018

Related U.S. Application Data

(60) Division of application No. 14/833,379, filed on Aug. 24, 2015, now Pat. No. 10,128,590, which is a (Continued)

(51) Int. Cl.
*H01R 12/70* (2011.01)
*H01R 4/50* (2006.01)
(Continued)

(52) U.S. Cl.
CPC ..... *H01R 12/7076* (2013.01); *H01R 4/5083* (2013.01); *H01R 12/774* (2013.01);
(Continued)

(58) Field of Classification Search
CPC . H01R 4/5083; H01R 12/7076; H01R 12/774
See application file for complete search history.

(56) References Cited

U.S. PATENT DOCUMENTS 6,042,412 A 3/2000 Murr
6,404,960 B1 6/2002 Hibbs-Brenner et al.
(Continued)

FOREIGN PATENT DOCUMENTS

TW M260895 4/2005

OTHER PUBLICATIONS

"U.S. Appl. No. 14/520,530 Office Action", dated Apr. 8, 2016, 8 pages.
List of IBM Patents or Applications Treated as Related.

*Primary Examiner* — Livius R. Cazan
(74) *Attorney, Agent, or Firm* — Teddi E. Maranzano

(57) ABSTRACT

Embodiments provide for a method for pluggable Land Grid Array (LGA) socket for high density interconnects. A method includes inserting an electrical-to-optical transceiver into an opening of a channel housing that is positioned above a land grid array connector located on an electrical package. After the electrical-to-optical transceiver is inserted into the channel housing, a tapered opening remains between an upper portion of the channel housing above the electrical-to-optical transceiver, wherein a gap of the tapered opening decreases progressively starting from the opening. The method includes inserting a conductive wedge into the gap of the tapered opening prior to communications through the electrical-to-optical transceiver between a component on the electrical package and a component external to the electrical package.

18 Claims, 9 Drawing Sheets

Related U.S. Application Data continuation of application No. 14/520,530, filed on Oct. 22, 2014, now Pat. No. 9,577,361.

(51) Int. Cl.

| | |
|---|---|
| ***H01R 12/77*** | (2011.01) |
| ***H01R 12/52*** | (2011.01) |
| ***H01R 12/71*** | (2011.01) |
| ***H01R 12/79*** | (2011.01) |

(52) U.S. Cl.

CPC ..... *H01R 12/523* (2013.01); *H01R 12/716* (2013.01); *H01R 12/772* (2013.01); *H01R 12/79* (2013.01)

(56) References Cited

U.S. PATENT DOCUMENTS

| | | | |
|---|---|---|---|
| 7,052,290 | B1 | 5/2006 | Thornton |
| 7,287,914 | B2 | 10/2007 | Fujiwara et al. |
| 7,534,052 | B2 | 5/2009 | Fujiwara et al. |
| 7,666,015 | B2 | 2/2010 | Sakamoto et al. |
| 8,081,470 | B2 | 12/2011 | Oki et al. |
| 8,083,547 | B2 | 12/2011 | Roth |
| 8,529,295 | B2 | 9/2013 | Sasaki et al. |
| 8,651,886 | B2 | 2/2014 | Tai et al. |
| 2004/0203289 | A1 | 10/2004 | Ice et al. |
| 2009/0296351 | A1 | 12/2009 | Oki et al. |
| 2013/0273768 | A1 | 10/2013 | Peng |
| 2016/0118731 | A1 | 4/2016 | Benner et al. |
| 2016/0118760 | A1 | 4/2016 | Benner et al. |

PLUGGABLE LGA SOCKET FOR HIGH DENSITY INTERCONNECTS

RELATED APPLICATIONS

This application is a divisional of and claims the priority benefit of U.S. application Ser. No. 14/833,379 filed Aug. 24, 2015, which is a continuation of and claims the priority benefit of U.S. application Ser. No. 14/520,530 filed Oct. 22, 2014.

BACKGROUND

Field of Invention

Embodiments of the present invention generally relate to the field of electrical connectors, and, more particularly, to electrical connectors for pluggable Land Grid Array (LGA) sockets.

Description of Related Art

Developers continue to attempt to increase the number of electronic components being included on a multi-chip module (MCM) while at the same time decreasing the size of the MCM. As a result, the heat generated by these densely populated components on a MCM during operation can be especially problematic during operation. Also, pluggable connectors for optical-to-electrical transceivers allow for optical communications external to the MCM to be converted to electrical communications for components on the MCM. Such pluggable connectors provide off-module optical communications that generally produce a high bandwidth communication with high reliability and high signal integrity. Similarly, some conventional pluggable connectors for optical-to-electrical transceivers can have a small area for heat removal, which implies high thermal impedance. Other conventional pluggable connectors can have a larger area for heat removal. However, these larger pluggable connectors can be physical large devices that consume a large amount of valuable surface area of the MCM.

Traditional high density LGA connectors provide contact alignment, engagement and establish reliable connections during insertion of a module into a socket in an orthogonal direction to a PCB surface. Insertion is often in a vertical direction for a horizontal board which deforms individual cantilevers, springs or electrically conductive elastic polymer contacts to maintain electrical connections. This actuation direction limits the possible configurations for tightly packed board components and drives board removal or open drawer access for field connections of LGA components. Ideally an exposed edge of a PCB or card with coplanar module insertion capability similar to an edge connector would be very useful. However these are often limited to contacts of only a few rows deep and have low contact array density to provide shielding for high speed signal contacts and wiring.

SUMMARY

In some embodiments, a method includes inserting an electrical-to-optical transceiver into an opening of a channel housing that is positioned above a land grid array connector located on an electrical package. After the electrical-to-optical transceiver is inserted into the channel housing, a tapered opening remains or is created between an upper portion of the channel housing above the electrical-to-optical transceiver, wherein a gap of the tapered opening decreases progressively starting from the opening. The method includes inserting a conductive wedge or wedges into the gap of the tapered opening prior to communications through the electrical-to-optical transceiver between a component on the electrical package and a component external to the electrical package.

BRIEF DESCRIPTION OF THE DRAWINGS

The present embodiments may be better understood, and numerous objects, features, and advantages made apparent to those skilled in the art by referencing the accompanying drawings.

DESCRIPTION OF EMBODIMENT(S)

The description that follows includes exemplary methods, techniques, and apparatuses that embody techniques of the present invention. However, it is understood that the described embodiments may be practiced without these specific details. For instance, although examples refer to multi-chip module (MCM), some embodiment can be used with any other type of electrical package, component board, substrate, or module. In other instances, well-known instruction instances, protocols, structures and techniques have not been shown in detail in order not to obfuscate the description.

Some embodiments provide a high thermally conductive path for a pluggable LGA connector that is used for off-chip optical-to-electrical communications. Some embodiments incorporate one or more insertable conductivity wedges that are to be positioned above a pluggable optical-to-electrical transceiver within a channel housing. The pluggable optical-to-electrical transceiver can be plugged into the channel housing such that the transceiver can be positioned above an LGA connector that is positioned on the MCM. The one or more thermally conductivity wedges positioned above the pluggable optical-to-electrical transceiver in the channel housing can create a Z motion socket contact actuation and thermal heat dissipation path away from the transceiver or other device mounted onto an MCM.

As further described below, the conductivity wedge(s) are positioned above the pluggable optical-to-electrical transceiver in the channel housing to create and maintain an electrical connection between the IO pads on the bottom surface of the pluggable optical-to-electrical transceiver and the LGA connector below. Additionally, the conductivity wedge(s) are positioned below a top of the channel housing, thereby providing a better thermal contact between the pluggable optical-to-electrical transceiver and the channel housing. The channel housing can include features to transfer heat to air cooled fins or pins, cold plates, heat pipes, thermoelectric coolers and other devices and media to further extract heat from the module.

Figure 1:
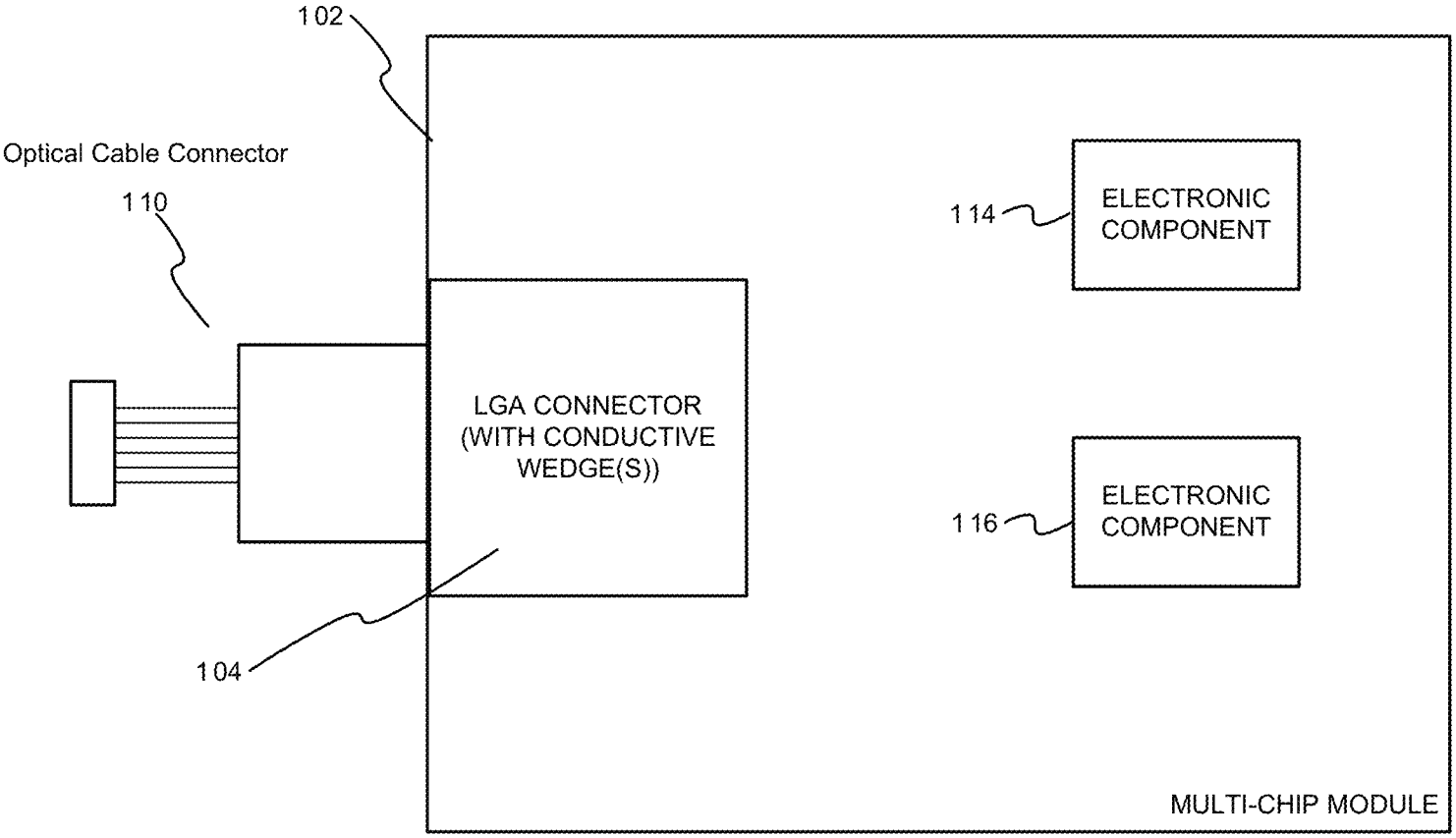
FIG. 1 depicts a multi-chip module that includes a Land Grid Array (LGA) connector with thermally conductive wedge(s) for a pluggable socket for off-chip communications, according to some embodiments.

FIG. 1 depicts a multi-chip module that includes a Land Grid Array (LGA) connector with thermally conductive wedge(s) for a pluggable socket for off-chip communications, according to some embodiments. FIG. 1 depicts an MCM 102 that includes multiple electronic components (an electronic component 114 and an electronic component 116). Examples of the electronic components 114-116 can include processors, memory, non-volatile storage, Input/Output devices, etc.

An LGA connector (with conductive wedge(s)) 104 is also on the MCM 102. Various example embodiments of the LGA connector (with conductive wedge(s)) 104 is depicted in FIGS. 3A-3B, 4A-4C, 7A-7B, and 8A-8B, which are described in more detail below. An optical cable connector 110 is communicatively coupled to an optical-to-electrical transceiver (not shown) that is plugged into the LGA connector (with conductive wedge(s)) 104.

Figure 2:
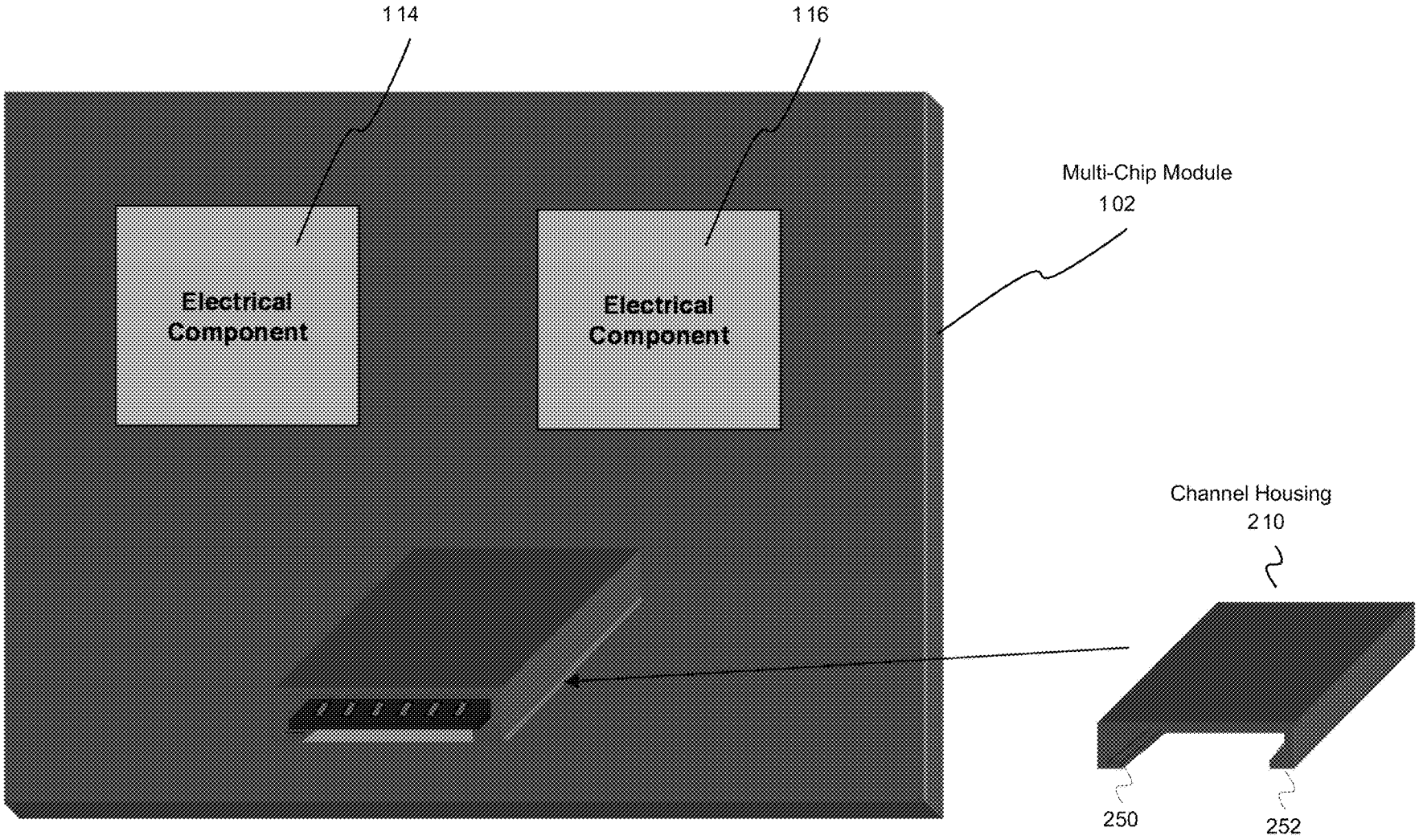
FIG. 2 depicts a multi-chip module that includes a channel housing to provide a means for aligning and actuating a pluggable socket for off-chip communications and to house thermally conductive wedge(s), according to some embodiments.
Figure 6:
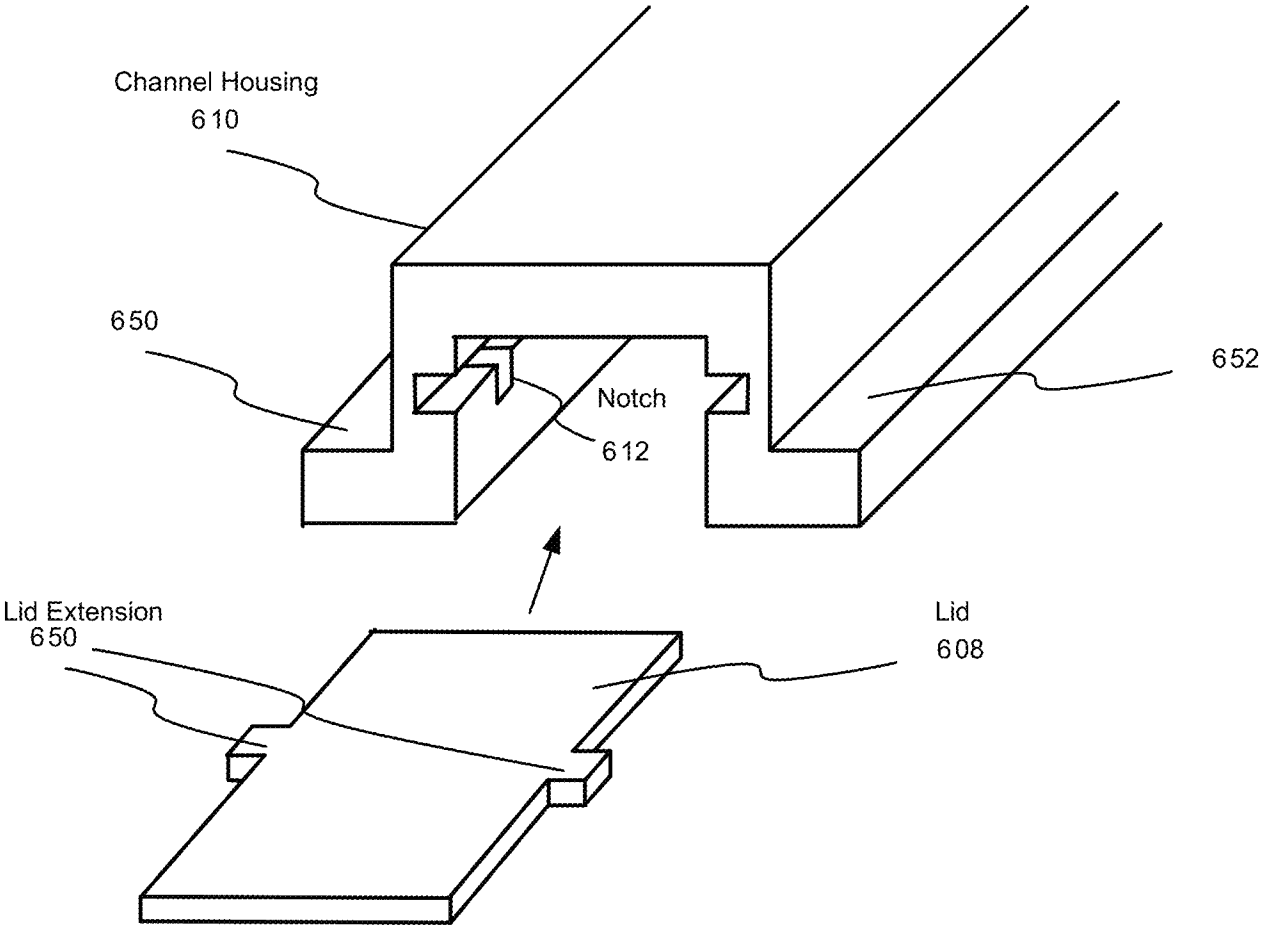
FIG. 6 depicts an isometric view of a channel housing and a conductive lid having a lid extension, according to some embodiments.

FIG. 2 depicts a multi-chip module that includes a channel housing to provide a pluggable socket for off-chip communications and to house thermally conductive wedge(s), according to some embodiments. In particular, FIG. 2 depicts the MCM 102 that includes the electrical components 114-116. Also, FIG. 2 depicts a channel housing 210 that is attached to the MCM 102 over the LGA connector (which is further described below). The channel housing 210 includes rails 250-252 that extend inward toward the housing space. A variant of the channel housing wherein the rails can extend outward from the housing space is depicted in FIG. 6 (which is described in more detail below). The rails 250-252 can be used to secure the channel housing 210 to the MCM 102. For example, the channel housing 210 can be secured to the MCM 102 through some type of adhesive and/or mechanical coupling (e.g., screws).

Figure 3A:
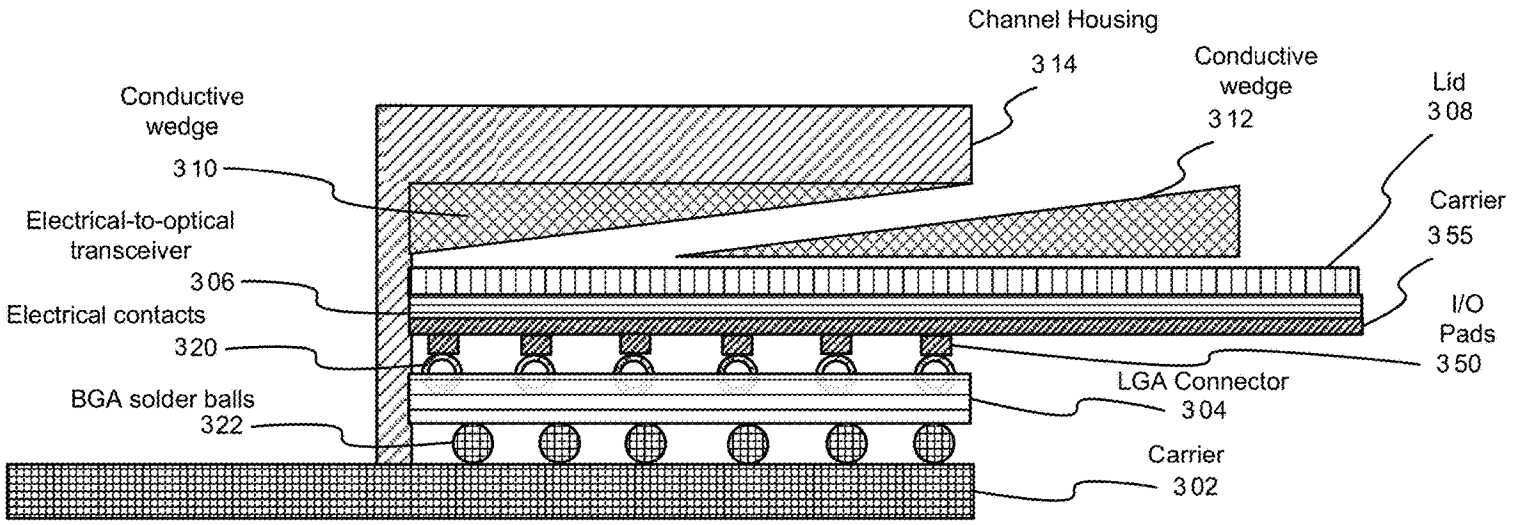
FIG. 3A depicts the cross-section of an LGA connector with two thermally conductive wedges for a pluggable socket for off-chip communications, according to some embodiments.
Figure 3B:
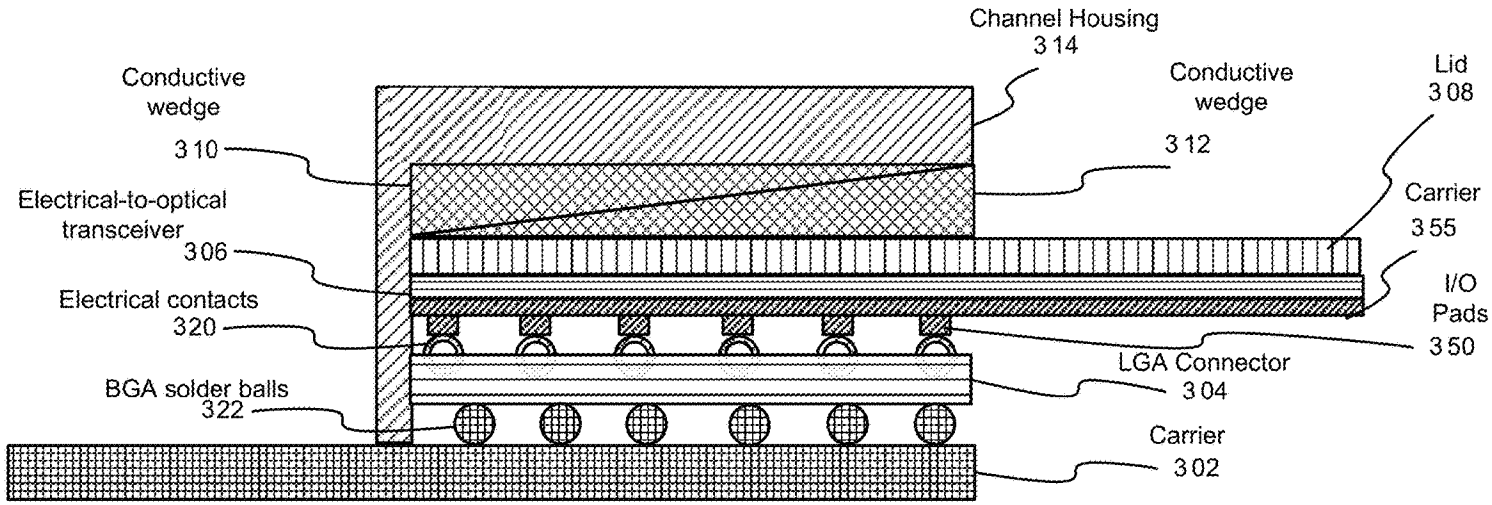
FIG. 3B depicts the cross-section of the LGA connector of FIG. 3A after insertion of the two thermally conductive wedges, according to some embodiments.

FIGS. 3A-3B depict the cross-section of an LGA connector with two thermally conductive wedges for a pluggable socket for off-chip communications, according to some embodiments. In particular, FIGS. 3A-3B depict a first example of the LGA connector 104 (with conductive wedge(s)) depicted in FIG. 1. In FIGS. 3A-3B, Ball Grid Array (BGA) solder balls 322 are positioned on a carrier 302. For example, the BGA solder balls 322 can be soldered onto the carrier 302. The carrier 302 can represent the MCM 102. The solder balls 322 are electrically connected to wiring within and on the carrier 302. FIGS. 3A-3B depict a cross-sectional side view that only includes six BGA solder balls. However, the BGA solder balls 322 can be part of a two-dimensional array of BGA solder balls (with the array being of varying sizes). For example, the BGA solder balls 322 can be part of a six-by-six array configuration, eight-by-eight array configuration, 10-by-12 array configuration, etc.

A LGA connector 304 is positioned above the BGA solder balls 322. For example, the LGA connector 304 can be soldered onto the BGA solder balls 322. The solder balls 322 provide electrical connectivity and mechanical connections between the LGA socket and the carrier. Electrical contacts 320 are positioned above the LGA connector 304. For example, the electrical contacts 320 can be soldered onto the LGA connector 304. Similar to the BGA solder balls 322, FIGS. 3A-3B depict a side view that only includes six electrical contacts. However, the electrical contacts 320 can be part of a two-dimensional array of electrical contacts (with the array being of varying sizes). For example, the electrical contacts 320 can be part of a six-by-six array configuration, eight-by-eight array configuration, 10-by-12 array configuration, etc. An electrical-to-optical transceiver 306 is positioned above the electrical contacts 320. For example, the electrical-to-optical transceiver 306 can include a silicon photonic component or silicon laser that uses silicon as an optical medium. The electrical-to-optical transceiver 306 can convert electrical signals to optical signals and vice versa. With reference to FIG. 1, the electrical-to-optical transceiver 306 can convert optical signals received from the off-module from the optical cable connector 110 to electrical signals that can be processed by the electrical components 114-116. Similarly, the electrical-to-optical transceiver 306 can convert electrical signals received from the electrical components 114-116 into optical signals for transmission off-module through an optical cable coupled to the optical cable connector 110. As shown, the electrical-to-optical transceiver 306 includes a lower portion that is a carrier 355 onto which components of the electrical-to-optical transceiver 306 reside to provide the conversion. The electrical-to-optical transceiver 306 also has input/output (I/O) pads 350 on the bottom surface of the carrier 355 for electrical connection to the electrical contacts 320. A lid 308 is positioned above the electrical-to-optical transceiver 306. The lid 308 can serve as a protective layer for the components in the electrical-to-optical transceiver 306 and can be composed of a conductive material to provide a conduit for thermal heat dissipation path away from the electrical-to-optical transceiver 306 and components contained therein to a channel housing 314 positioned above.

FIGS. 3A-3B depicts two conductive wedges that are removable from below the channel housing 314—a conductive wedge 310 and a conductive wedge 312. As shown in FIGS. 3A-3B, the conductive wedge 310 is already inserted below the channel housing 314 and above the electrical-to-optical transceiver 306. FIG. 3A depicts the conductive wedge 312 as not yet having been inserted below the conductive wedge 310. FIG. 3B depicts the conductive wedge 312 after being inserted below the conductive wedge 310. As shown, the conductive wedges 310-312 can have essentially a same shape, such that the edge of the conductive wedge 312 that is inserted below the channel housing 314 is opposite of the edge of conductive wedge 310 that is inserted. Accordingly after the conductive wedges 310-312 are inserted below the channel housing 314 and above the electrical-to-optical transceiver 306, a downward force in the Z-direction can be applied to provide an enhanced electrical connection between the electrical-to-optical transceiver 306 and the electrical contacts 320 as shown by compressed electrically contacts 320. Also, the downward force in the Z-direction can provide an enhanced thermal heat dissipation path away from the electrical-to-optical transceiver 306. In FIGS. 3A-3B, only the conductive wedge 312 is shown as being inserted into the channel housing 314. However, the electrical-to-optical transceiver 306 and the lid 308 can be inserted into and removed from the channel housing 314.

Figure 4A:
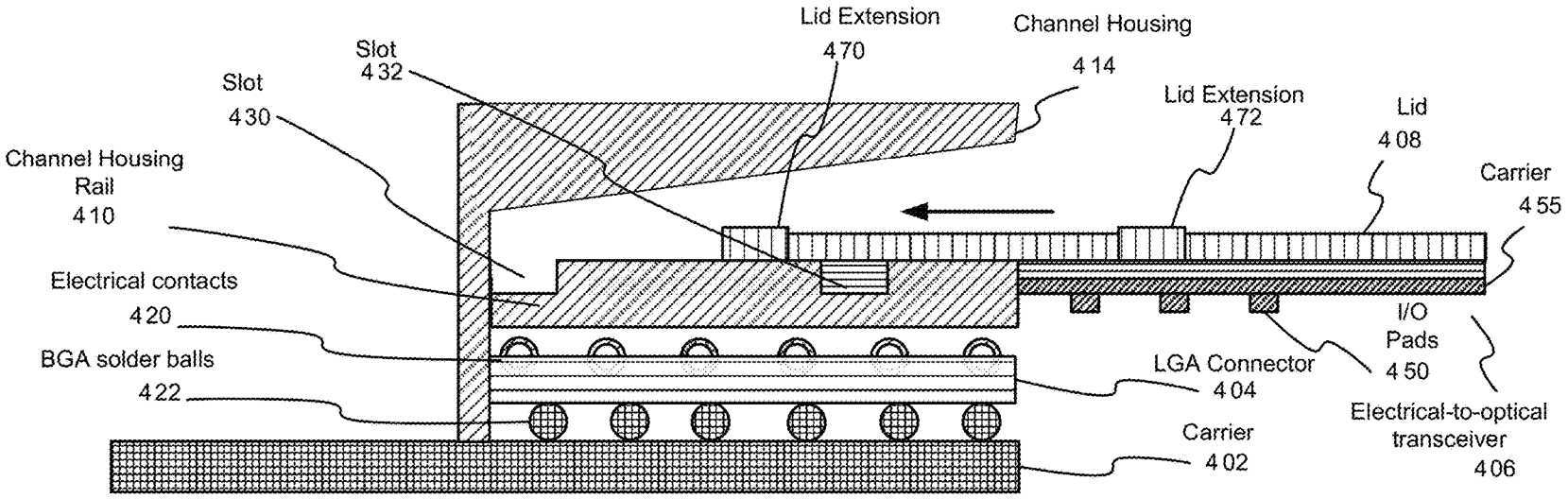
FIG. 4A depicts a cross-section of an LGA connector in a channel housing that includes channel housing rails for a pluggable socket for off-chip communications, according to some embodiments.
Figure 4B:
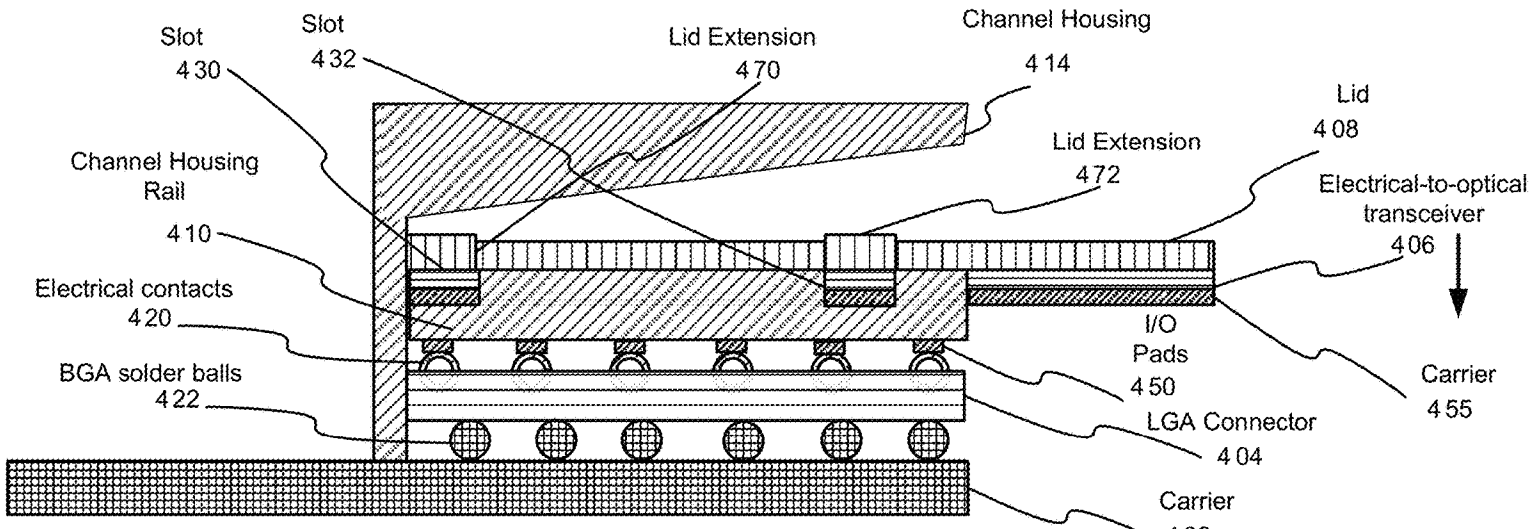
FIG. 4B depicts a cross-section of the LGA connector of FIG. 4A after inserting the electrical-to-optical transceiver at a first point in time, according to some embodiments.
Figure 4C:
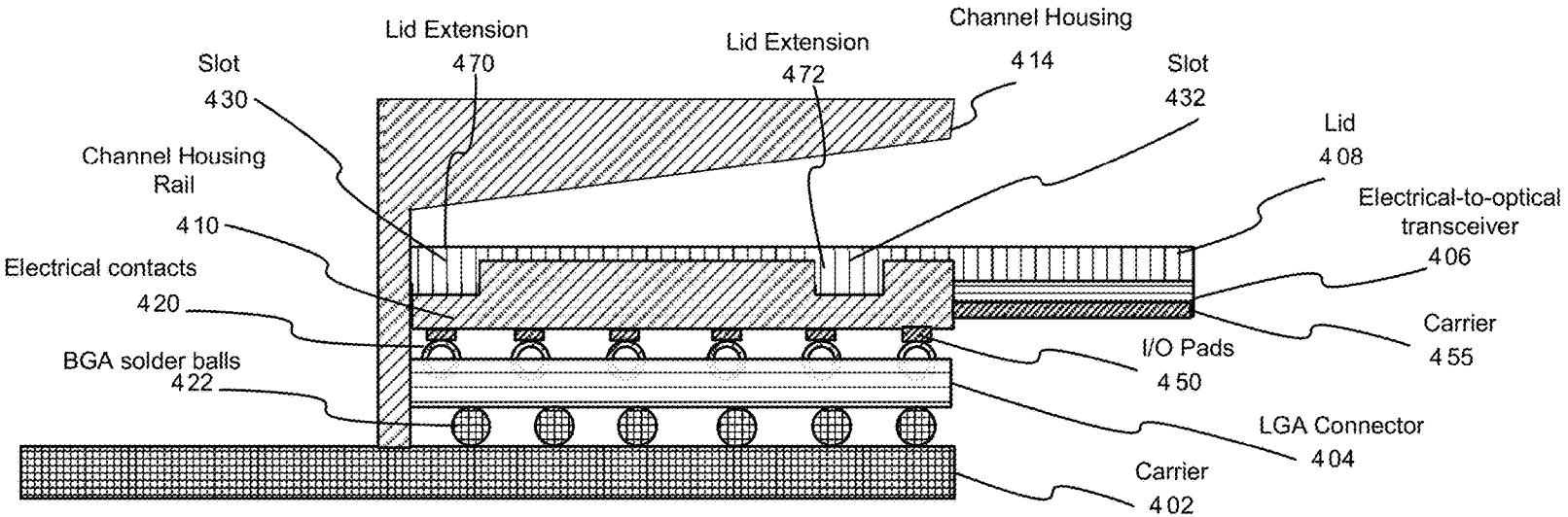
FIG. 4C depicts a cross-section of the LGA connector of FIG. 4A after inserting the electrical-to-optical transceiver at a second point in time, according to some embodiments.

FIGS. 4A-4C depict a cross-section of an LGA connector in a channel housing that includes channel housing rails for a pluggable socket for off-chip communications, according to some embodiments. In particular, FIGS. 4A-4C depict a second example of the LGA connector 104 (with a conductive wedge) depicted in FIG. 1. FIG. 4A-4C depict an LGA connector at three different points in time. FIG. 4A depicts the LGA connector prior to inserting an electrical-to-optical transceiver 406 and a lid 408 into a channel housing 414. FIG. 4B depicts the LGA connector after inserting the electrical-to-optical transceiver 406 and the lid 408 into the channel housing 414 but prior to maneuvering the electrical-to-optical transceiver 406 and the lid 408 to its final position prior to inserting a conductive wedge.

In FIGS. 4A-4C, Ball Grid Array (BGA) solder balls 422 are positioned on a carrier 402. For example, the BGA solder balls 422 can be soldered onto the carrier 402. The carrier 402 can represent the MCM 102. FIGS. 4A-4C depict a side view that only includes six BGA solder balls. However, the BGA solder balls 422 can be part of a two-dimensional array of BGA solder balls (with the array being of varying sizes). For example, the BGA solder balls 422 can be part of a six-by-six array configuration, eight-by-eight array configuration, 10-by-12 array configuration, etc.

A LGA connector 404 is positioned above the BGA solder balls 422. For example, the LGA connector 404 can be soldered onto the BGA solder balls 422. Electrical contacts 420 are positioned above the LGA connector 404. For example, the electrical contacts 420 can be soldered onto the LGA connector 404. Similar to the BGA solder balls 422, FIGS. 4A-4C depict a side view that only includes six electrical contacts. However, the electrical contacts 420 can be part of a two-dimensional array of electrical contacts (with the array being of varying sizes). For example, the electrical contacts 420 can be part of a six-by-six array configuration, eight-by-eight array configuration, 10-by-12 array configuration, etc. An electrical-to-optical transceiver 406 is positioned above the electrical contacts 420. The electrical-to-optical transceiver 406 includes a lower portion that is a carrier 455 onto which components of the electrical-to-optical transceiver 406 reside to provide the conversion. The electrical-to-optical transceiver 406 also has input/output (I/O) pads 450 on the bottom surface of the carrier 355 for electrical connection to the electrical contacts 420. The electrical-to-optical transceiver 406 can convert electrical signals to optical signals and vice versa (as described above).

A lid 408 is positioned above the electrical-to-optical transceiver 406. The lid 408 can serve as a protective layer for the components in the electrical-to-optical transceiver 406 and can be composed of a conductive material to provide a conduit for thermal heat dissipation path away from the electrical-to-optical transceiver 406 and toward a channel housing 414 positioned above.

In contrast to the example depicted in FIGS. 3A-3B, the example depicted in FIGS. 4A-4C includes a channel housing rail 410 that is part of a channel housing 414. The channel housing rail 410 includes a number of slots (two slots in this example—a slot 430 and a slot 432). Also, the lid 408 includes lid extensions 470-472. The lid extension 470 is positioned in the slot 430, and the lid extension 472 is positioned into the slot 432. This configuration enables a better aligned and more secure fitting of the lid 408 and an electrical-to-optical transceiver 406 into the channel housing 414. Also in this example, a single conductive wedge is used. Specifically, the single conductive wedge can be placed above the lid 408 and below the top of the channel housing 414 after the electrical-to-optical transceiver 406 and the lid 408 are secured in the channel housing 414. In some other embodiments, multiple conductive wedges can be used (similar to the example depicted in FIGS. 3A-3B). Accordingly after the conductive wedge is inserted below the top of the channel housing 414 and above the electrical-to-optical transceiver 406, a downward force in the Z-direction can be applied to provide an enhanced electrical connection between the electrical-to-optical transceiver 406 and the electrical contacts 420. Also, the downward force in the Z-direction can provide an enhanced thermal heat dissipation path away from the electrical-to-optical transceiver 406.

Figure 5:
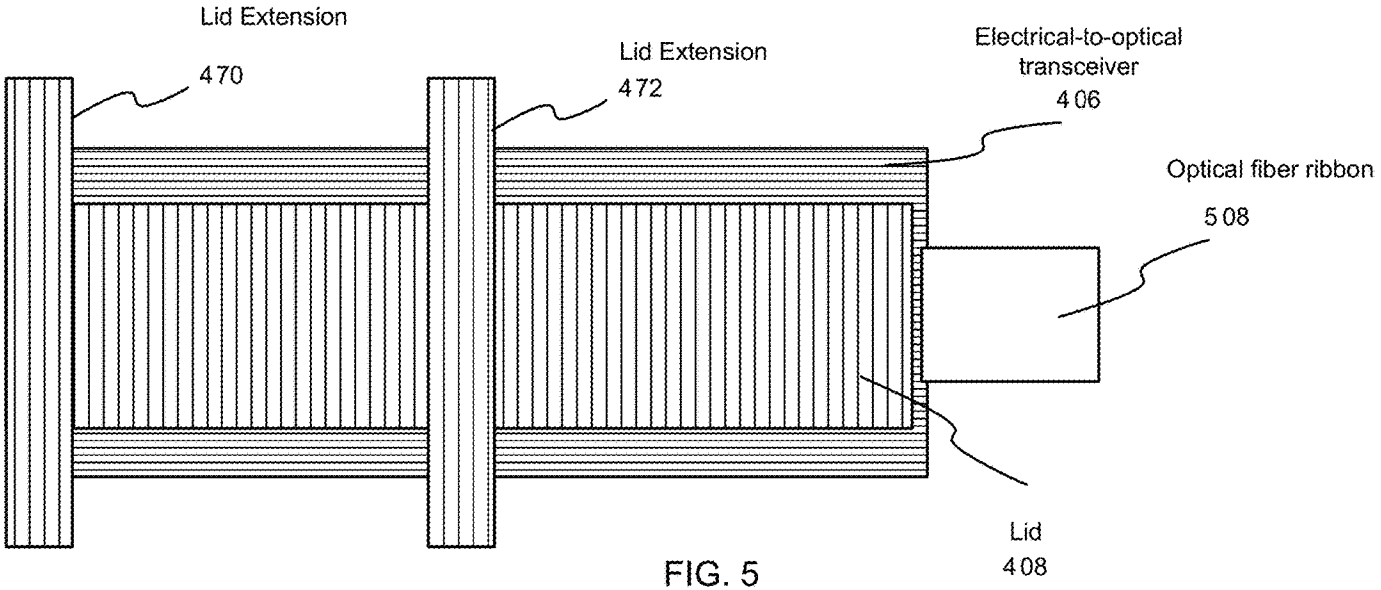
FIG. 5 depicts a top view of a conductive lid and electrical-to-optical transceiver for the LGA connector of FIGS. 4A-4C, according to some embodiments.

To help illustrate, FIG. 5 depicts a top view of a conductive lid and electrical-to-optical transceiver for the LGA connector of FIGS. 4A-4C, according to some embodiments. The electrical-to-optical transceiver 406 is coupled to an optical fiber ribbon 508 to receive and transmit optical communications from and to the MCM. The lid 408 is positioned on top of the electrical-to-optical transceiver 406. As shown in FIG. 5, the lid 408 includes the lid extensions 470-472.

FIG. 6 depicts an isometric view of a channel housing and a conductive lid having a lid extension, according to some embodiments. FIG. 6 helps illustrate the placement of the lid having a lid extension within a channel housing. FIG. 6 depicts a channel housing 610 that includes a notch 612. Also (not shown), the channel housing 610 includes a second notch on the opposite side of the channel housing 610 across from the notch 612. A lid 608 includes a lid extension 650. As described above, the lid 608 can be slid into the channel housing 610 such that the lid extensions 650 are fitted into the notch 612 and the opposite notch (not shown). Also of note, FIG. 6 depicts a variant of the channel housing. In particular, the channel housing 610 includes rails 650-652 that extend outward from the housing space. This variant of the channel housing is in contrast to the channel housing 210 depicted in FIG. 2. Specifically, the channel housing 210 of FIG. 2 includes rails that extend inward toward the housing space. As described above, the rails for either variant can be used to secure the channel housing to the MCM. For example, the channel housing can be secured to the MCM through some type of adhesive and/or mechanical coupling (e.g., screws).

Figure 7A:
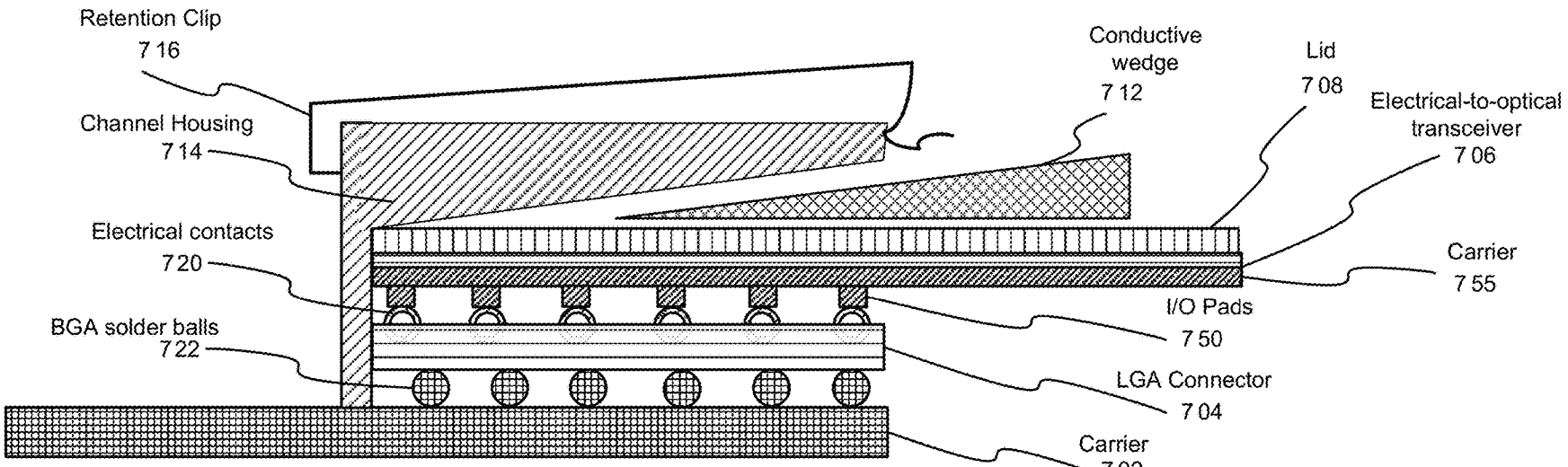
FIG. 7A depicts a LGA connector with a retention clip for holding a position of a conductive wedge for a pluggable socket for off-chip communications, according to some embodiments.
Figure 7B:
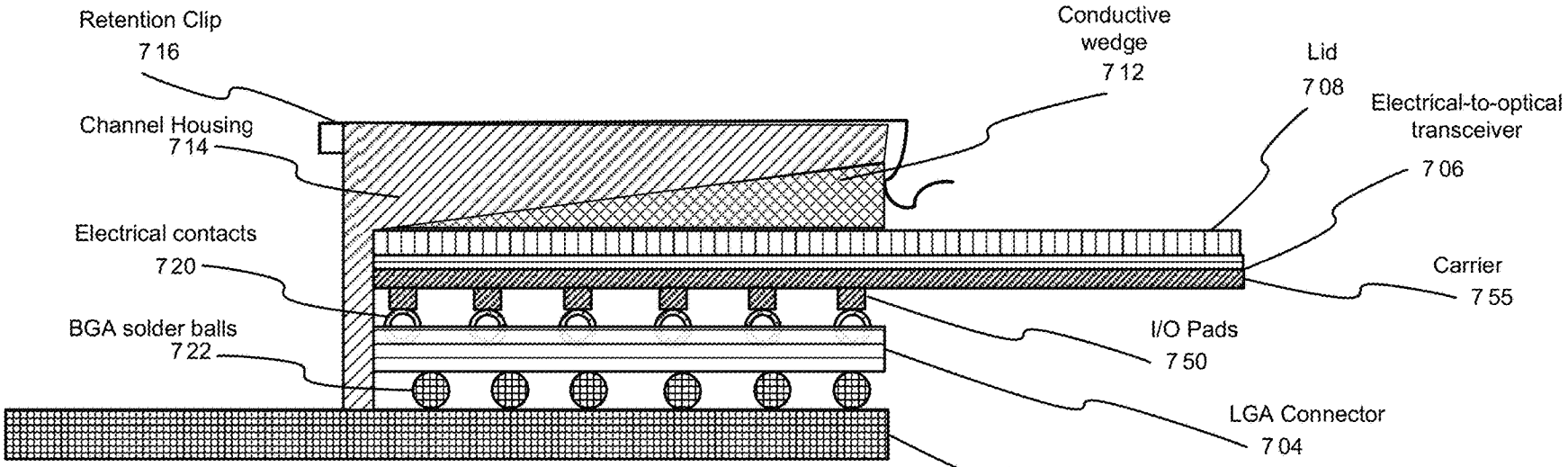
FIG. 7B depicts the LGA connector of FIG. 7A after inserting the conductive wedge and placement of the retention clip, according to some embodiments.

FIGS. 7A-7B depict a LGA connector with a retention clip for holding a position of a conductive wedge for a pluggable socket for off-chip communications, according to some embodiments. In particular, FIGS. 7A-7B depict a third example of the LGA connector 104 (with a conductive wedge) depicted in FIG. 1. FIG. 7A-7B depict an LGA connector at two different points in time. FIG. 7A depicts the LGA connector prior to inserting a conductive wedge 712 above an electrical-to-optical transceiver 706 and a lid 708 and below a channel housing 714. FIG. 7B depicts the LGA connector after inserting the conductive wedge 712 above the electrical-to-optical transceiver 706 and the lid 708 and below the channel housing 714.

In FIGS. 7A-7B, Ball Grid Array (BGA) solder balls 722 are positioned on a carrier 702. For example, the BGA solder balls 722 can be soldered onto the carrier 702. The carrier 702 can represent the MCM 102. FIGS. 7A-7B depict a side view that only includes six BGA solder balls. However, the BGA solder balls 722 can be part of a two-dimensional array of BGA solder balls (with the array being of varying sizes). For example, the BGA solder balls 722 can be part of a six-by-six array configuration, eight-by-eight array configuration, 10-by-12 array configuration, etc.

A LGA connector 704 is positioned above the BGA solder balls 722. For example, the LGA connector 704 can be soldered onto the BGA solder balls 722. Electrical contacts 720 are positioned above the LGA connector 704. For example, the electrical contacts 720 can be soldered onto the LGA connector 704. Similar to the BGA solder balls 722, FIGS. 7A-7B depict a side view that only includes six electrical contacts. However, the electrical contacts 720 can be part of a two-dimensional array of electrical contacts (with the array being of varying sizes). For example, the electrical contacts 720 can be part of a six-by-six array configuration, eight-by-eight array configuration, 10-by-12 array configuration, etc. An electrical-to-optical transceiver 706 is positioned above the electrical contacts 720. As shown, the electrical-to-optical transceiver 706 includes a lower portion that is a carrier 755 onto which components of the electrical-to-optical transceiver 706 reside to provide the conversion. The electrical-to-optical transceiver 706 also has input/output (I/O) pads 750 on the bottom surface of the carrier 755 for electrical connection to the electrical contacts 720. The electrical-to-optical transceiver 706 can convert electrical signals to optical signals and vice versa (as described above).

A lid 708 is positioned above the electrical-to-optical transceiver 706. The lid 708 can serve as a protective layer for the components in the electrical-to-optical transceiver 706 and can be composed of a conductive material to provide a conduit for thermal heat dissipation path away from the electrical-to-optical transceiver 706 and toward a channel housing 714 positioned above.

In this example, a single conductive wedge is used. Specifically, a conductive wedge 712 can be placed above the lid 708 and below the top of the channel housing 714. In some other embodiments, multiple conductive wedges can be used (similar to the example depicted in FIGS. 3A-3B). Accordingly after the conductive wedge is inserted below the top of the channel housing 714 and above the electrical-to-optical transceiver 706, a downward force in the Z-direction can be applied to provide an enhanced electrical connection between the electrical-to-optical transceiver 706 and the electrical contacts 720. Also, the downward force in the Z-direction can provide an enhanced thermal heat dissipation path away from the electrical-to-optical transceiver 706. In FIGS. 7A-7B, only the conductive wedge 712 is shown as being inserted into the channel housing 714. However, the electrical-to-optical transceiver 706 and the lid 708 can be inserted into and removed from the channel housing 714.

In contrast to the examples depicted in FIGS. 3A-3B and FIGS. 4A-4C, the LGA connector includes a retention clip 716 that extends over the top of the channel housing 714. As shown, after the conductive wedge 712 is inserted into the channel housing 714, the retention clip 716 can be lowered to secure the conductive wedge 712 in the channel housing 714.

Figure 8A:
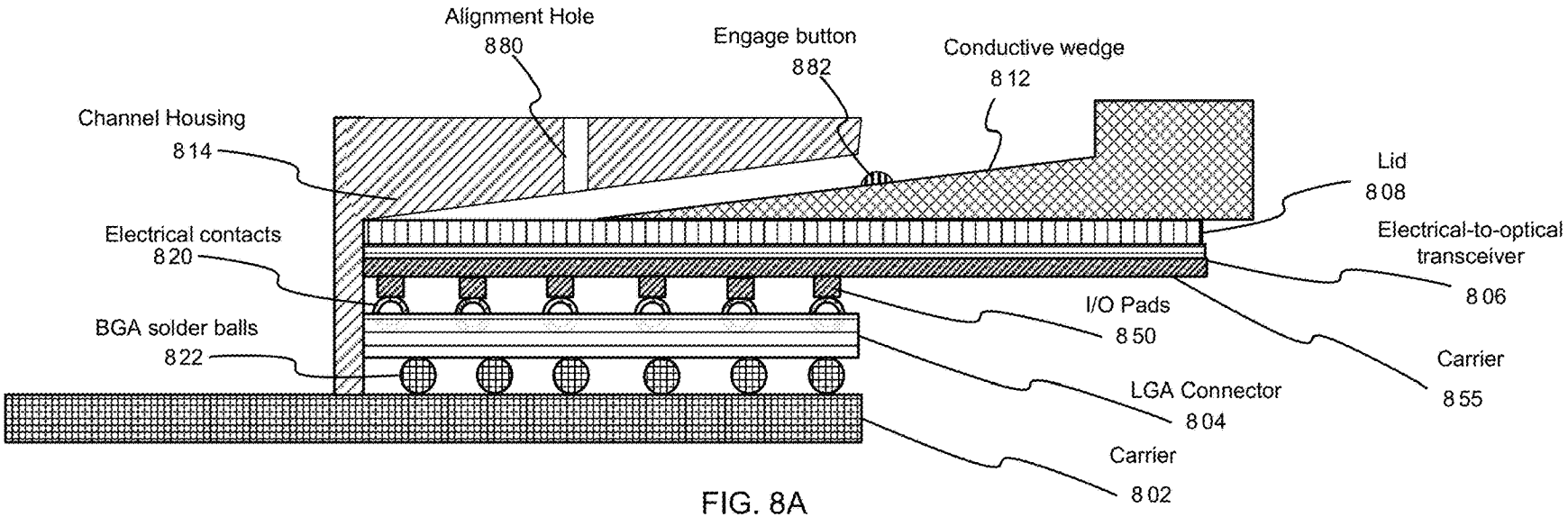
FIG. 8A depicts a LGA connector with an alignment button for holding a position of a conductive wedge for a pluggable socket for off-chip communications, according to some embodiments.
Figure 8B:
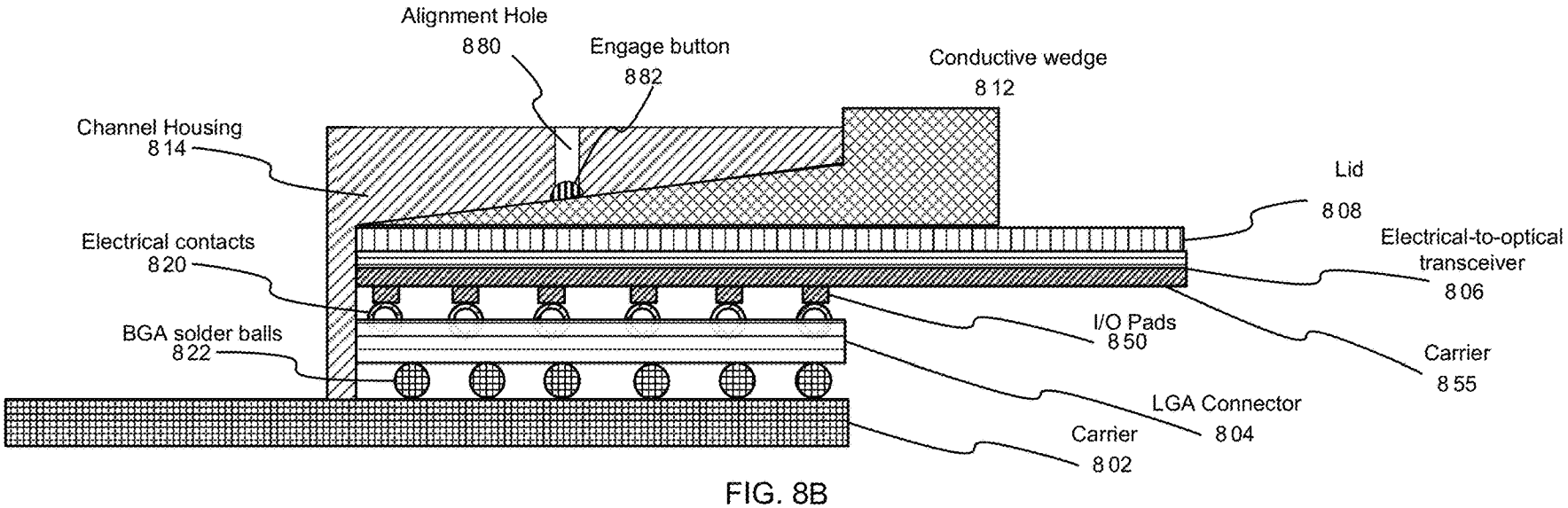
FIG. 8B depicts the LGA connector of FIG. 8A after inserting the conductive wedge, according to some embodiments.

FIGS. 8A-8B depict a LGA connector with an alignment button for holding a position of a conductive wedge for a pluggable socket for off-chip communications, according to some embodiments. In particular, FIGS. 8A-8B depict a fourth example of the LGA connector 104 (with a conductive wedge) depicted in FIG. 1. FIG. 8A-8B depict an LGA connector at two different points in time. FIG. 8A depicts the LGA connector prior to inserting a conductive wedge 812 above an electrical-to-optical transceiver 806 and a lid 808 and below a channel housing 814. FIG. 8B depicts the LGA connector after inserting the conductive wedge 812 above the electrical-to-optical transceiver 806 and the lid 808 and below the channel housing 814.

In FIGS. 8A-8B, Ball Grid Array (BGA) solder balls 822 are positioned on a carrier 802. For example, the BGA solder balls 822 can be soldered onto the carrier 802. The carrier 802 can represent the MCM 102. FIGS. 8A-8B depict a side view that only includes six BGA solder balls. However, the BGA solder balls 822 can be part of a two-dimensional array of BGA solder balls (with the array being of varying sizes). For example, the BGA solder balls 822 can be part of a six-by-six array configuration, eight-by-eight array configuration, 10-by-12 array configuration, etc.

A LGA connector 804 is positioned above the BGA solder balls 822. For example, the LGA connector 804 can be soldered onto the BGA solder balls 822. Electrical contacts 820 are positioned above the LGA connector 804. For example, the electrical contacts 820 can be soldered onto the LGA connector 804. Similar to the BGA solder balls 822, FIGS. 8A-8B depict a side view that only includes six electrical contacts. However, the electrical contacts 820 can be part of a two-dimensional array of electrical contacts (with the array being of varying sizes). For example, the electrical contacts 820 can be part of a six-by-six array configuration, eight-by-eight array configuration, 10-by-12 array configuration, etc. An electrical-to-optical transceiver 806 is positioned above the electrical contacts 820. As shown, the electrical-to-optical transceiver 806 includes a lower portion that is a carrier 855 onto which components of the electrical-to-optical transceiver 806 reside to provide the conversion. The electrical-to-optical transceiver 806 also has input/output (I/O) pads 850 on the bottom surface of the carrier 855 for electrical connection to the electrical contacts 820. The electrical-to-optical transceiver 806 can convert electrical signals to optical signals and vice versa (as described above).

A lid 808 is positioned above the electrical-to-optical transceiver 806. The lid 808 can serve as a protective layer for the components in the electrical-to-optical transceiver 806 and can be composed of a conductive material to provide a conduit for thermal heat dissipation path away from the electrical-to-optical transceiver 806 and toward a channel housing 814 positioned above.

In this example, a single conductive wedge is used. Specifically, a conductive wedge 812 can be placed above the lid 808 and below the top of the channel housing 814. In some other embodiments, multiple conductive wedges can be used (similar to the example depicted in FIGS. 3A-3B). Accordingly after the conductive wedge is inserted below the top of the channel housing 814 and above the electrical-to-optical transceiver 806, a downward force in the Z-direction can be applied to provide an enhanced electrical connection between the electrical-to-optical transceiver 806 and the electrical contacts 820. Also, the downward force in the Z-direction can provide an enhanced thermal heat dissipation path away from the electrical-to-optical transceiver 806. In FIGS. 8A-8B, only the conductive wedge 812 is shown as being inserted into the channel housing 814. However, the electrical-to-optical transceiver 806 and the lid 808 can be inserted into and removed from the channel housing 814.

In contrast to the examples depicted in FIGS. 3A-3B, FIGS. 4A-4C, and FIGS. 7A-7B, the channel housing 814 includes an alignment hole 880 and the conductive wedge 812 includes an engage button 882. As shown, after the conductive wedge 812 is fully and properly inserted into the channel housing 814, the engage button 882 locks into the alignment hole 880. Such a configuration enables the conductive wedge 812 to be securely positioned in the channel housing 814.

Whiles FIGS. 3A-3B, 4A-4C, 5, 7A-7B, and 8A-8B depict separate examples of how to secure the electrical-to-optical transceiver above the LGA connector in a channel housing, in some embodiments, one or more of these separate examples can be practiced together. For example, some embodiments can include both a retention clip and a spring. In another example, some embodiments can include a retention clip and the alignment hole/engage button.

While most figures. depict a lid as the load bearing and thermally conductive surface, when a full size lid is not used a smaller heat spreader attached directly to component(s) on the carrier 855 can also be used.

Also, while BGA connections are shown to provide the electrical connection of the LGA to a PCB, it is realized that dual side compressively loaded LGA contacts can also be used in the LGA actuation process. This would require mechanical alignment and retention of the socket during component insertion and actuation since the socket is not retained by soldered connections. Means for holding the socket in place such as glue or alignment holes and guide pins would be used by those skilled in the art.

Figure 9:
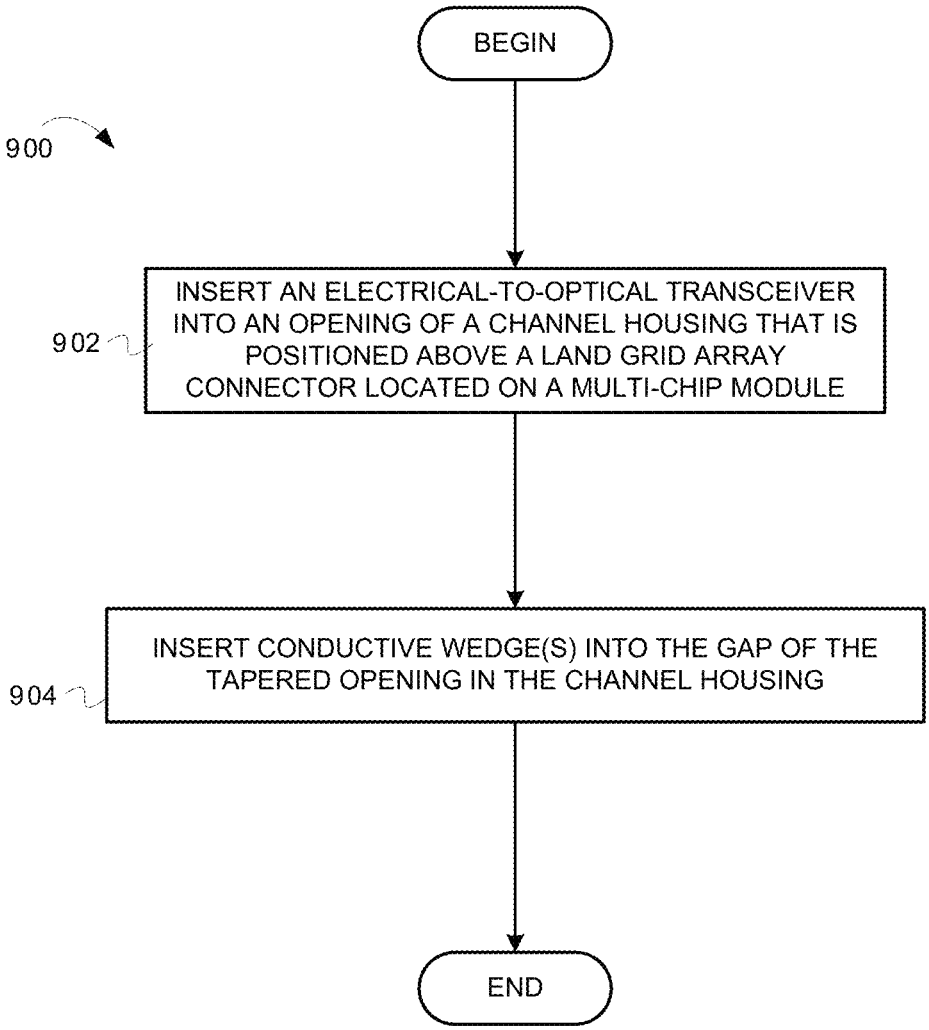
FIG. 9 depicts a flowchart of operations for configuring a pluggable electrical-to-optical transceiver for communications with a LGA connector through a channel housing on a multi-chip module, according to some embodiments.

FIG. 9 depicts a flowchart of operations for configuring a pluggable electrical-to-optical transceiver for communications with a LGA connector through a channel housing on a multi-chip module, according to some embodiments. The operations of a flowchart 900 of FIG. 9 are described in reference to the example depicted in FIGS. 3A-3B. However, such operations are applicable to any of the example described above. Prior to the operations of the flowchart 900, a MCM includes the carrier 302 with the LGA connector 304 attached to the carrier 302 through the BGA solder balls 322. Also, the LGA connector 304 includes electrical contacts 320. The channel housing 314 is also attached on top of the carrier 302. Operations of the flowchart 900 begin at block 902.

At block 902, an electrical-to-optical transceiver is inserted into an opening of the channel housing that is positioned above the LGA connector located on a multi-chip module. With reference to FIG. 3, the electrical-to-optical transceiver 306 is inserted into an opening of the channel housing 314 above the electrical contacts 320 of the LGA connector 304. The lid 308 can also be inserted into the opening of the channel housing 314 above the electrical contacts 320 of the LGA connector 304 and above the electrical-to-optical transceiver 306. Operations of the flowchart 900 continue at block 904.

At block 904, conductive wedge(s) are inserted into the gap of the tapered opening in the channel housing. With reference to FIG. 3, the conductive wedge 310 can be inserted into the channel housing 314 and the conductive wedge 312 can be inserted into the tapered opening below the channel housing 314 and above the electrical-to-optical transceiver 306. Accordingly after the conductive wedges 310-312 are inserted below the channel housing 314 and above the electrical-to-optical transceiver 306, a downward force in the Z-direction can be applied to provide an enhanced electrical connection between the electrical-to-optical transceiver 306 and the electrical contacts 320. Also, the downward force in the Z-direction can provide an enhanced thermal heat dissipation path away from the electrical-to-optical transceiver 306. Also, the MCM can become operational to provide communications through the electrical-to-optical transceiver 206 between a component on the MCM and a component external to the MCM (as described above in reference to FIG. 1).

Various embodiments herein are described in reference to electrical/optical conversion. Some other embodiments can also be incorporated into a standard electrical connector (e.g., a copper cable with a connector on the end).

Aspects of the present invention are described with reference to flowchart illustrations and/or block diagrams of methods, and apparatus (systems) according to embodiments of the invention. While the embodiments are described with reference to various implementations and exploitations, it will be understood that these embodiments are illustrative and that the scope of the invention is not limited to them. In general, techniques for electrical connectors for pluggable LGA sockets as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the invention. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the invention.

What is claimed is:

1. A method comprising:

inserting an electrical-to-optical transceiver into an opening of a channel housing that is positioned above a land grid array connector located on an electrical package;

inserting a first conductive wedge into the opening of the channel housing and above the electrical-to-optical transceiver, wherein a tapered opening remains in the channel housing after the first conductive wedge and the electrical-to-optical transceiver are inserted into the channel housing, wherein a gap of the tapered opening decreases progressively starting from the opening; and inserting a second conductive wedge into the gap of the tapered opening.

2. The method of claim 1, wherein a first end of a retention clip is coupled to a side of the channel housing that is opposite the tapered opening, wherein the retention clip runs along a top of the channel housing, wherein the method comprises:

moving the retention clip into a position to secure at least one of the first conductive wedge or the second conductive wedge into the opening of the channel housing.

3. The method of claim 1, further comprising:

positioning a conductive lid on top of the electrical-to-optical transceiver, wherein the first conductive wedge and the second conductive wedge are inserted above the conductive lid.

4. The method of claim 3, wherein the conductive lid comprises at least one lid extension.

5. The method of claim 4, wherein the channel housing comprises a channel housing rail that includes at least one slot, wherein positioning the conductive lid on top of the electrical-to-optical transceiver comprises placing the at least one lid extension in the at least one slot.

6. The method of claim 1, wherein an alignment hole is vertically aligned in the channel housing and an engage button is positioned on top of the second conductive wedge.

7. The method of claim 6, wherein inserting the second conductive wedge into the gap of the tapered opening comprises placing the engage button in the alignment hole.

8. The method of claim 1, wherein the second conductive wedge causes a downward force to be applied to the electrical-to-optical transceiver, wherein the downward force provides electrical connection between the electrical-to-optical transceiver and the land grid array connector.

9. The method of claim 1, wherein the second conductive wedge, when inserted in the channel housing, provides a thermal heat dissipation path away from the electrical-to-optical transceiver.

10. An apparatus comprising:

a land grid array connector positioned above an electrical package;

a channel housing positioned above the land grid array connector;

an electrical-to-optical transceiver positioned in an opening of the channel housing; a first conductive wedge for inserting into the opening of the channel housing and above the electrical-to-optical transceiver, wherein a tapered opening remains in the channel housing after the first conductive wedge and the electrical-to-optical transceiver are inserted into the channel housing, wherein a gap of the tapered opening decreases progressively starting from the opening; and a second conductive wedge for inserting into the gap of the tapered opening.

11. The apparatus of claim 10, further comprising:

a retention clip, wherein a first end of the retention clip is coupled to a side of the channel housing that is opposite the tapered opening, wherein the retention clip runs along a top of the channel housing.

12. The apparatus of claim 10, further comprising a conductive lid positioned above the electrical-to-optical transceiver and below the first conductive wedge.

13. The apparatus of claim 12, wherein the conductive lid comprises at least one lid extension.

14. The apparatus of claim 13, wherein the channel housing comprises a channel housing rail that includes at least one slot, wherein the at least one lid extension is placed in the at least one slot.

15. The apparatus of claim 10, wherein an alignment hole is vertically aligned in the channel housing and an engage button is positioned on top of the second conductive wedge.

16. The apparatus of claim 10, wherein the channel housing comprises attachment railings to secure the channel housing to the electrical package.

17. The apparatus of claim 10, wherein the second conductive wedge causes a downward force to be applied to the electrical-to-optical transceiver, wherein the downward force provides electrical connection between the electrical-to-optical transceiver and the land grid array connector.

18. The apparatus of claim 10, and wherein the second conductive wedge, when inserted in the channel housing, provides a thermal heat dissipation path away from the electrical-to-optical transceiver.

* * * * *